US009602930B2

(12) United States Patent
Park

(10) Patent No.: US 9,602,930 B2
(45) Date of Patent: Mar. 21, 2017

(54) DUAL DIAPHRAGM MICROPHONE

(71) Applicant: QUALCOMM Incorporated, San Diego, CA (US)

(72) Inventor: Hyun Jin Park, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 87 days.

(21) Appl. No.: 14/675,384

(22) Filed: Mar. 31, 2015

(65) Prior Publication Data

US 2016/0295328 A1 Oct. 6, 2016

(51) Int. Cl.

| | |
|---|---|
| ***H04R 19/04*** | (2006.01) |
| ***H04R 7/02*** | (2006.01) |
| ***H04R 19/00*** | (2006.01) |
| ***H04R 1/22*** | (2006.01) |
| ***H04R 23/00*** | (2006.01) |

(Continued)

(52) U.S. Cl.

CPC ..... *H04R 7/02* (2013.01); *H04R 1/08* (2013.01); *H04R 1/222* (2013.01); *H04R 19/005* (2013.01); *H04R 19/04* (2013.01); *H04R 23/006* (2013.01); *H04R 3/005* (2013.01); *H04R 2201/003* (2013.01); *H04R 2410/05* (2013.01)

(58) Field of Classification Search

CPC ..... H04R 1/38; H04R 3/005; H04R 17/02; H04R 19/013; H04R 19/016; H04R 19/02; H04R 19/04; H04R 2410/01; H04R 2410/05; H04R 2499/11; H04R 1/222; H04R 19/005; H04R 23/006; H04R 2201/003

USPC ..... 381/92, 113, 116, 355, 356, 357, 358, 381/361, 369, 182, 173, 174, 190, 191; 29/25.41, 25.42

See application file for complete search history.

(56) References Cited

U.S. PATENT DOCUMENTS 3,008,013 A * 11/1961 Walker ..... H04R 19/02 381/116
4,160,882 A * 7/1979 Driver ..... H04R 19/013 381/116

(Continued)

FOREIGN PATENT DOCUMENTS

| | | | |
|---|---|---|---|
| DE | 102010015400 | A1 | 10/2011 |
| EP | 0782371 | A2 | 7/1997 |
| WO | WO-9522878 | A2 | 8/1995 |

OTHER PUBLICATIONS

International Search Report and Written Opinion—PCT/US2016/022493—ISA/EPO—Jun. 13, 2016.

*Primary Examiner* — Huyen D Le

(74) *Attorney, Agent, or Firm* — Knobbe Martens Olson & Bear LLP

(57) ABSTRACT

A dual diaphragm microphone can be used to reduce or eliminate a component of the output signal due to acceleration of the microphone. The dual diaphragm microphone can include a first sound-detecting component including a first diaphragm spaced apart from a first electrode and configured to generate a first signal and a second sound-detecting component including a second diaphragm spaced apart from a second electrode and configured to generate a second signal. The first sound-detecting component and the second sound-detecting component are oriented in opposite directions and include electronic circuitry configured to sum the first and second output signals to generate a combined output signal substantially unaffected by acceleration of the microphone.

29 Claims, 9 Drawing Sheets

(51) Int. Cl.
*H04R 1/08* (2006.01)
*H04R 3/00* (2006.01)

(56) References Cited

U.S. PATENT DOCUMENTS

| | | | | |
|---|---|---|---|---|
| 5,363,452 | A | 11/1994 | Anderson | |
| 6,985,597 | B2 * | 1/2006 | Akino | H04R 1/38 381/174 |
| 7,840,020 | B1 | 11/2010 | Miller, III et al. | |
| 2008/0101625 | A1 | 5/2008 | Fazzio et al. | |
| 2011/0172996 | A1 | 7/2011 | Takano et al. | |
| 2011/0176690 | A1 | 7/2011 | Takano et al. | |
| 2014/0270275 | A1 | 9/2014 | Niedzwiedz et al. | |

* cited by examiner

DUAL DIAPHRAGM MICROPHONE

FIELD

This disclosure relates to microphones. In particular, this disclosure is directed to microphone devices, systems, and methods configured to produce an output signal substantially free from a component caused by mechanical vibration or physical acceleration of the microphone.

BACKGROUND

Some microphones use a deformable diaphragm to convert sound into an electrical signal. Sound, in the form of pressure waves, causes the diaphragm to deform generating an output signal that may be proportional to the change in pressure acting on the diaphragm. Mechanical vibration or physical acceleration of the microphone itself can also cause the diaphragm to deform. The vibration or acceleration-induced deformation can also generate or affect the microphone's output signal. Accordingly, a microphone may produce an output signal which includes a first component indicative of the sound waves incident on the microphone and a second component resulting from vibration or acceleration of the microphone. These two components may be difficult to distinguish, and any alteration of the microphone's output signal not caused by sound waves may be undesirable.

Many consumer devices include a microphone to measure, record, or transmit audio signals. Frequently, such consumer devices may also be portable and many are handheld. For example, cell phones often include a microphone to record and transmit a user's voice. Microphones in these devices often experience vibration or acceleration during use, which can affect the microphone's output signal.

SUMMARY

This disclosure relates to microphone devices, systems, and methods configured to provide an output signal that eliminates or reduces any component of the output signal that may be caused by physical acceleration or vibration of the microphone itself. The devices, systems, and methods of this disclosure each have several innovative aspects, no single one of which is solely responsible for the desirable attributes disclosed herein.

In some aspects, a microphone may include a first microphone component configured to generate a first signal with a first pressure deformable diaphragm having an external side facing a first direction, the first signal varying with deformation of the first deformable diaphragm, a second microphone component configured to generate a second signal with a second pressure deformable diaphragm having an external side facing a second direction, the second signal varying with deformation of the second deformable diaphragm, the second direction being substantially opposite the first direction, and electronic circuitry configured to sum the first and second signals to generate an output signal. In some aspects, the first microphone component is rigidly attached to the second microphone component. The first pressure deformable diaphragm may be oriented in a position parallel to the second pressure deformable diaphragm. The output signal of the microphone may be substantially free from a component due to acceleration of the microphone.

In some aspects, a microphone includes a first sound-detecting component including a first diaphragm spaced apart from a first electrode and configured to generate a first signal; a second sound-detecting component including a second diaphragm spaced apart from a second electrode and configured to generate a second signal, wherein the first sound-detecting component and the second sound-detecting component are oriented in opposite directions, and electronic circuitry configured to sum the first and second output signals to generate a combined output signal. In some aspects, the first sound-detecting component is rigidly attached to the second sound-detecting component. The combined output signal may be substantially unaffected by acceleration of the microphone. Each of the first and second sound-detecting components may be exposed to the ambient. In some aspects, the first diaphragm is oriented in a position parallel to the second diaphragm.

In some aspects, a dual-diaphragm microphone includes a first pressure deformable diaphragm at least partially enclosing a first volume, a first sensing electrode disposed within the first volume and spaced apart from the first pressure deformable diaphragm, a second pressure deformable diaphragm at least partially enclosing a second volume, the second pressure deformable diaphragm oriented substantially parallel to the first pressure deformable diaphragm, and a second sensing electrode disposed within the second volume and spaced apart from the second pressure deformable diaphragm, the first and second sensing electrodes disposed respectively on opposite sides of the first and second pressure deformable diaphragms. The microphone may also include body, and wherein the first and second volumes are at least partially defined by the body. In some aspects, the first and second volumes are substantially aligned along an axis extending perpendicularly to the first pressure deformable diaphragm. In some aspects, the first and second pressure deformable diaphragms and the first and second sensing electrodes are also substantially aligned along the axis extending perpendicularly to the first pressure deformable diaphragm. In some aspects, the first and second volumes are substantially aligned along an axis perpendicular to an axis extending perpendicularly to the first pressure deformable diaphragm.

In some aspects, a method includes receiving a first signal from a first sound-detecting component oriented in a first direction, receiving a second signal from a second sound-detecting component rigidly attached to the first sound-detecting component and oriented in a second direction substantially opposite the first direction, and summing the first and second signals to produce a combined output that is substantially free from signal components generated by acceleration of the first and second sound-detecting components. The first sound-detecting component may include a first pressure deformable diaphragm including an exterior surface oriented to face the ambient in the first direction, and wherein the second sound-detecting component may include a second pressure deformable diaphragm including an exterior surface oriented to face the ambient in the second direction substantially opposite the first direction. In some aspects, the first and second pressure deformable diaphragms are configured such that a component of the first and second signals caused by changes in air pressure is substantially equal in magnitude and polarity. In some aspects, the first and second pressure deformable membranes are configured such that a component of the first and second signals caused by acceleration of the microphone is substantially equal in magnitude and opposite in polarity.

In some aspects, a microphone includes a first microphone component configured to generate a first signal, including a first pressure deformable diaphragm having an external side facing a first direction, the first signal varying with deformation of the first deformable diaphragm, and a first electrode spaced apart from an internal side of the first pressure deformable diaphragm and disposed within a first volume at least partially enclosed by the first pressure deformable diaphragm, a second microphone component configured to generate a second signal, including a second pressure deformable diaphragm having an external side facing a second direction, the second signal varying with deformation of the second deformable diaphragm, and the second direction being substantially opposite the first direction, and a second electrode spaced apart from the second pressure deformable diaphragm and disposed within a second volume at least partially enclosed by the second pressure deformable diaphragm, a housing configured to at least partially surround the first microphone component and the second microphone component, the housing including at least one aperture configured to expose the first pressure deformable diaphragm to the ambient, the housing sonically isolating the second pressure deformable diaphragm, and electronic circuitry configured to sum the first and second signals to generate an output signal.

Details of one or more implementations of the subject matter described in this disclosure are set forth in the accompanying drawings and the description below. Other features, aspects, and advantages will become apparent from the description, the drawings, and the claims.

It is to be understood that not necessarily all objects or advantages may be achieved in accordance with any particular implementation described herein. For example, aspects of certain implementations may be embodied or carried out in a manner that achieves or optimizes one advantage or group of advantages as taught herein without necessarily achieving other objects or advantages as may be taught or suggested by other implementations. Moreover, the various aspects and features from different implementations may be interchangeable.

BRIEF DESCRIPTION OF THE DRAWINGS

The following is a brief description of each of the drawings. From figure to figure, like reference numerals are used to designate like components or steps of the implementations discussed herein. Note that the relative dimensions of the following figures may not be drawn to scale.

DETAILED DESCRIPTION

The present disclosure discusses microphone devices, systems, and methods configured to reduce or eliminate components of the output signal that may be caused by physical acceleration or vibration of the microphone itself. In general, some implementations of microphones use a membrane to detect changes in air pressure caused by sound pressure waves and convert displacement of the membrane into an electrical signal indicative of the sound waves. However, displacement of the microphone membrane may also be induced by movement or vibration of the microphone, and this displacement of the microphone membrane will also produce or alter an output signal of the microphone. Such an acceleration-induced signal component can be difficult to distinguish from a signal generated by incident sound waves. In some implementations, a dual diaphragm microphone may be configured that produces a combined output signal that is substantially unaffected by acceleration or other movement of the microphone.

Figure 1:
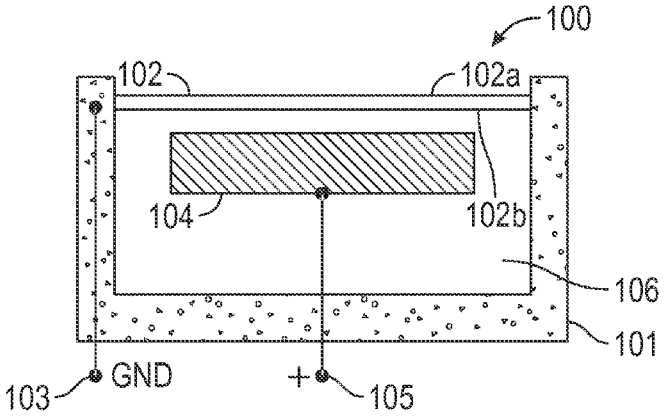
FIG. 1 illustrates an implementation of a microphone.

FIG. 1 illustrates an implementation of a microphone 100. In some implementations, the microphone 100 is any acoustic-to-electric transducer or sensor that converts sound into an electrical signal. In some implementations, a microphone may be a dynamic microphone, condenser microphone, electric condenser microphone, analog/digital MEMS microphone, or other sound-detecting device.

Microphone 100 includes a body 101, diaphragm 102, and sensing electrode 104. Diaphragm 102 may be connected to body 101 to define a volume 106 which is at least partially enclosed. In some implementations, the volume 106 is filled with compressible air. Sensing electrode 104 is mounted within volume 106 and spaced apart from diaphragm 102. In some implementations, sensing electrode 104 is rigidly mounted or otherwise secured within volume 106 to create a fixed spatial relationship between body 101 and sensing electrode 104.

Diaphragm 102 may be a pressure deformable membrane. In some implementations, an external side 102*a* of diaphragm 102 is exposed to the ambient, either directly as shown or via an aperture in a body or housing enclosing the microphone 100. Sound waves from outside the microphone 100 will reach and impact the external side 102*a* of diaphragm 102. Internal side 102*b* of diaphragm 102 is oriented towards volume 106 and is spaced apart from the sensing electrode 104. In some implementations, sensing electrode 104 may be connected to an output terminal 105, and an output signal of microphone 100 can be measured at output terminal 105. Output terminal 105 may, in some implementations, be in electrical communication with other circuitry, such as amplifiers or filters, for further processing of an output signal. In some implementations, diaphragm 102 may be connected to a ground terminal 103 used to ground the microphone circuit. In some implementations, the connections to the ground terminal 103 and the output terminal 105 may be reversed. For example, the sensing electrode 104 can be connected to the ground terminal 103 and the diaphragm 102 can be connected to the output terminal 105. As will be discussed more fully below, microphone 100 produces an output signal in response to deformation, displacement, or movement of diaphragm 102 relative to the sensing electrode 104.

In some implementations, an output signal of microphone 100 can be a voltage. For example, in some implementations, microphone 100 can be configured as a condenser microphone with a membrane or diaphragm 102 and a sensing electrode 104 functioning as plates of a capacitor. As diaphragm 102 deforms in response to incident sound waves, the distance between the diaphragm 102 and sensing electrode 104 varies. The change in distance between the diaphragm 102 and sensing electrode 104 causes a change in capacitance and a resultant change in voltage across the capacitor formed by diaphragm 102 and sensing electrode 104. This changing voltage over time may be the output signal of microphone 100.

In other implementations, a microphone can be configured as a dynamic microphone with an induction coil attached to a diaphragm and positioned within a magnetic field of a permanent magnet. As the diaphragm deforms, movement of the induction coil through the magnetic field produces a varying current by electromagnetic induction. The varying current can generate a voltage change, for example, across an attached resistor. In some implementations, this varying voltage or varying current can be the output signal of the microphone. The term output signal is used throughout this application to denote any electrical signal (voltage, current, capacitance, or other) produced by a microphone in response to deformation of the diaphragm.

In some implementations, microphone 100 can include additional components or features not specifically illustrated in FIG. 1. For example, microphone 100 can include additional electronic circuitry for processing and/or transmitting the output signal of the microphone 100. In some implementations, microphone 100 can include additional structural components, such as a guard configured to protect the external side 102*a* of diaphragm 102 without preventing sound from reaching the diaphragm 102. In some implementations, microphone 100 may be integrated within or connected to another device, such as a cellular telephone, tablet, or other electronic device.

In FIG. 1, microphone 100 is shown with diaphragm 102 in an undeformed or resting position. This position can represent a state where the ambient air pressure acting upon exterior surface 102*a* of diaphragm 102 is substantially equal to the air pressure within volume 106, which acts upon the interior surface 102*b* of the diaphragm. This position represents a baseline position for diaphragm 102 where the output signal generated by microphone 100 may be at a baseline state, which in some implementations may be approximately zero.

Figure 2A:
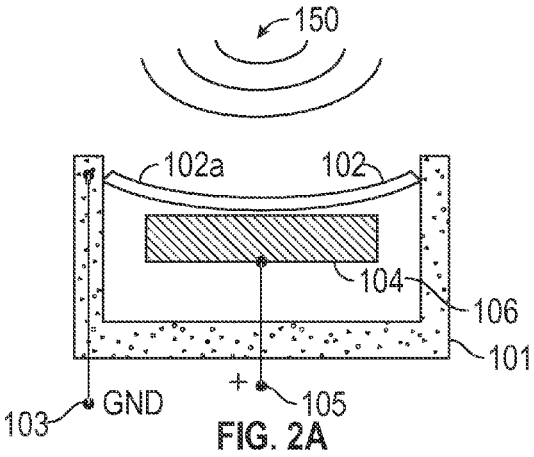
FIGS. 2A and 2B illustrate output signal generation in a microphone due to deformation of the diaphragm caused by sound waves.
Figure 2B:
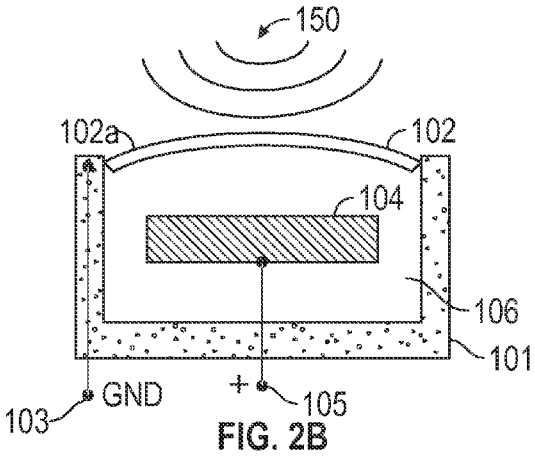

FIGS. 2A and 2B illustrate the generation of an output signal by microphone 100 due to deformation of diaphragm 102 caused by changes in air pressure associated with sound waves 150. Specifically, FIG. 2A illustrates inward deformation of diaphragm 102 and FIG. 2B illustrates outward deformation of a diaphragm 102.

As shown in FIGS. 2A and 2B, sound waves 150 acting on the exterior surface 102*a* of diaphragm 102 may cause diaphragm 102 of microphone 100 to deform in a manner that either decreases or increases the distance between the electrode 104 and the diaphragm 102. For example, as shown in FIG. 2A, inward deformation (toward the sensing electrode 104) may occur as sound waves 150 impact on diaphragm 102 because of a pressure differential induced by the sound waves 150. Similarly, as shown in FIG. 2B, outward deformation (toward the sensing electrode 104) may occur as diaphragm 102 springs back from the position shown in FIG. 2A or because of a pressure differential between a higher pressure in volume 106 and a lower pressure acting on the exterior side 102*a* of diaphragm 102.

The output signal generated by microphone 100 at output terminal 105 represents the change in signal from the baseline position of the diaphragm 102 (the at rest position) shown in FIG. 1 and described above. For purposes of establishing a convention to be used throughout this application, an outward deformation of diaphragm 102 may cause a positive output signal, and an inward deformation of diaphragm 102 may cause a negative output signal. A person skilled in the art, however, will understand that this convention may be reversed without departing from the scope of this disclosure.

In some implementations, the diaphragm 102 is configured such that the deformation of the diaphragm 102 is substantially proportional to the pressure differential throughout the range of pressures to which the microphone 100 is expected to be exposed. Accordingly, the magnitude of the output signal of microphone 100 may also be proportional to the pressure of the sound waves 150 being measured.

A person skilled in the art will appreciate that microphone 100 need not be directional. For example, in some implementations, microphone 100 may be substantially omnidirectional and sound waves 150 originating from any direction can cause the deformation of diaphragm 102. Accordingly, sound waves 150 depicted in FIGS. 2A and 2B are merely provided by way of example, and any illustrated directionality of sound waves 150 is not required.

Figure 3B:
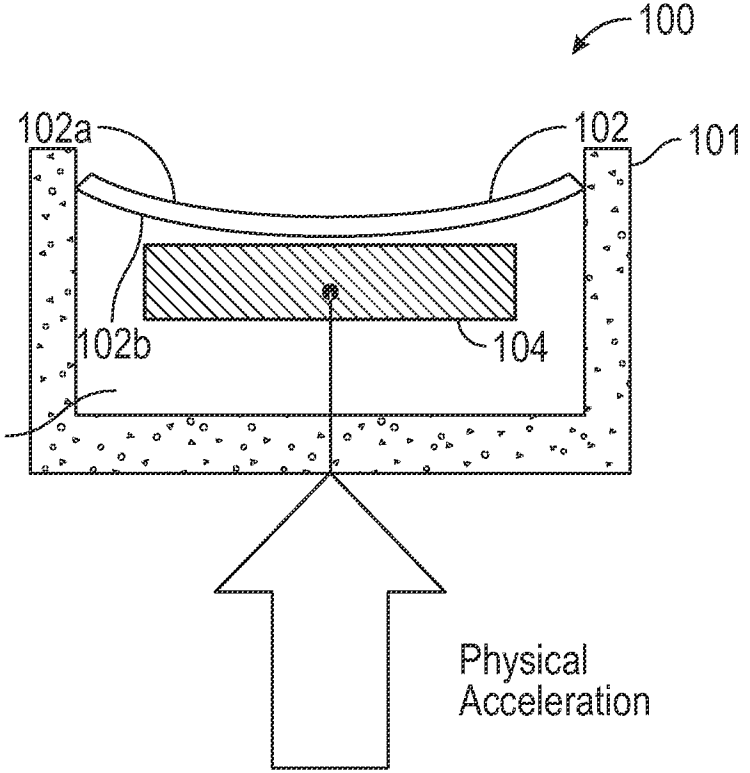
FIGS. 3A and 3B illustrate output signal generation in a microphone due to deformation of the diaphragm caused by physical acceleration.
Figure 3A:
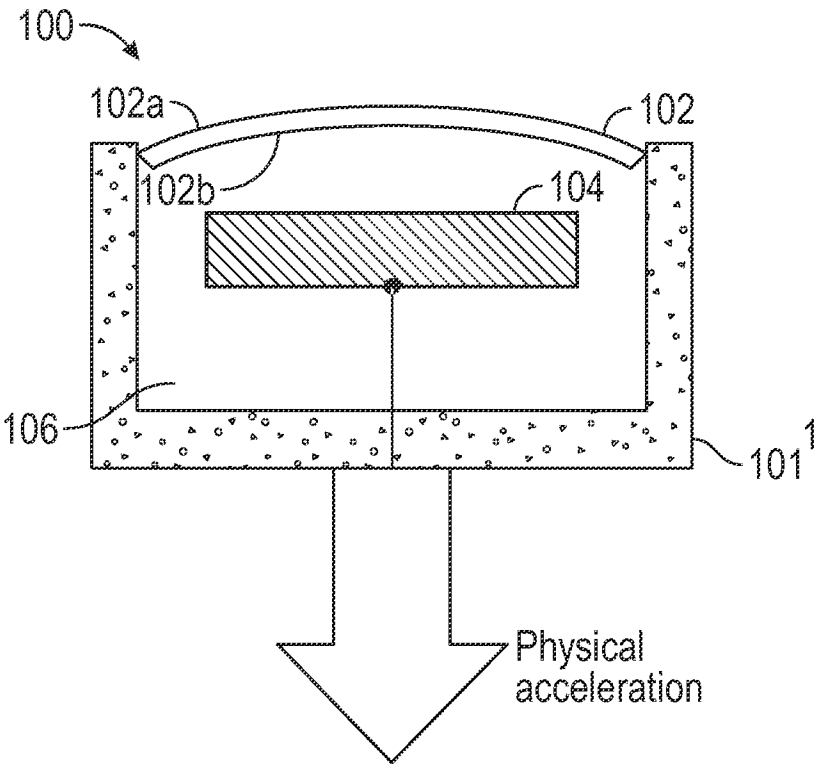

FIGS. 3A and 3B illustrate deformation of diaphragm 102 caused by the physical acceleration of the microphone 100, which can also generate or affect the output signal of the microphone 100. Specifically, FIG. 3A illustrates outward deformation of the diaphragm 102 of microphone 100, and FIG. 3B illustrates inward deformation of the diaphragm 102 of microphone 100. In the figures, upward and downward directions are defined relative to an axis extending orthogonal to the surface of undeformed diaphragm 102 (see FIG. 1), with downward indicating a direction extending orthogonal to the plane of undeformed diaphragm 102 and toward the sensing electrode 104. Similarly, upward indicates an opposite direction extending orthogonal to the plane of undeformed diaphragm 102 and away from the sensing electrode 104. Accordingly, in the FIGS. 3A and 3B the term upward refers to a direction towards the top of the figure and the term downward refers to a direction towards the bottom of the figure.

Body 101 of microphone 100 may generally be made from a rigid material, such that it does not substantially deform under acceleration. As discussed above, the sensing electrode 104 is disposed within volume 106 and may be rigidly attached to body 101. Sensing electrode 104 may also be sufficiently rigid so as to not substantially deform when the microphone is vibrated, dropped, moved, or otherwise subjected to acceleration. Accordingly, as microphone 100 undergoes acceleration, the spatial relationship between body 101 and sensing electrode 104 remains constant. Because the diaphragm 102 is not rigid, the spatial relationship between the diaphragm 102 and the sensing electrode 104 varies when the microphone is under the effects of acceleration.

As shown in FIG. 3A, if microphone 100 accelerates in a downward direction, the diaphragm 102 will not move downward at the same rate as the remainder of the microphone 100, resulting in an initial outward deformation of the diaphragm 102. The outward deformation increases the distance between diaphragm 102 and sensing electrode 104, producing a positive output signal. As shown in FIG. 3B, if microphone 100 accelerates in an upward direction, the diaphragm 102 will not move upward at the same rate as the remainder of the microphone 100, causing an initial inward deformation of the diaphragm 102. The inward deformation decreases the distance between diaphragm 102 and sensing electrode 104, producing a negative output signal.

Accordingly, implementations of microphone 100 can produce an output signal which includes components resulting from sound-induced deformation and components resulting from acceleration-induced deformation. At times, microphone 100 may be exposed to sound waves while under acceleration or while the diaphragm 102 is still oscillating due to recent acceleration, such that the relative spacing between the diaphragm 102 and the sensing electrode 104 will be influenced by both the incident sound and the acceleration-induced movement of the diaphragm 102, each of which contribute to the output signal. In some implementations, it can be difficult to distinguish between the components of the output signal resulting from acceleration and the components of the output signal resulting from exposure of the microphone 100 to incident sound waves.

Purely lateral acceleration of microphone 100, that is, acceleration in the plane of the diaphragm 102 in an undeformed state, may not produce substantial deformation of diaphragm 102. Accordingly, purely lateral acceleration of microphone 100 may not affect the output signal. However, any acceleration of microphone 100 that has any upward or downward component will produce an effect on the output signal which may be indistinguishable from the effect of incident sound waves on the output signal.

One of skill in the art will understand that the output signal of microphone 100 may include a signal component which is caused by sound (as described in reference to FIGS. 2A and 2B) and a signal component which is caused by acceleration of microphone 100 (as described in reference to FIGS. 3A and 3B). In most applications, however, it can be advantageous to isolate the component of the output signal resulting from incident sound waves. For example, the acceleration-induced component of the output signal may be problematic in various microphone applications including, for example, sound capture, active noise cancellation, or transmission uplink processing. Accordingly, a microphone design capable of reducing or eliminating the component of output signal due to acceleration is desirable.

Figure 4:
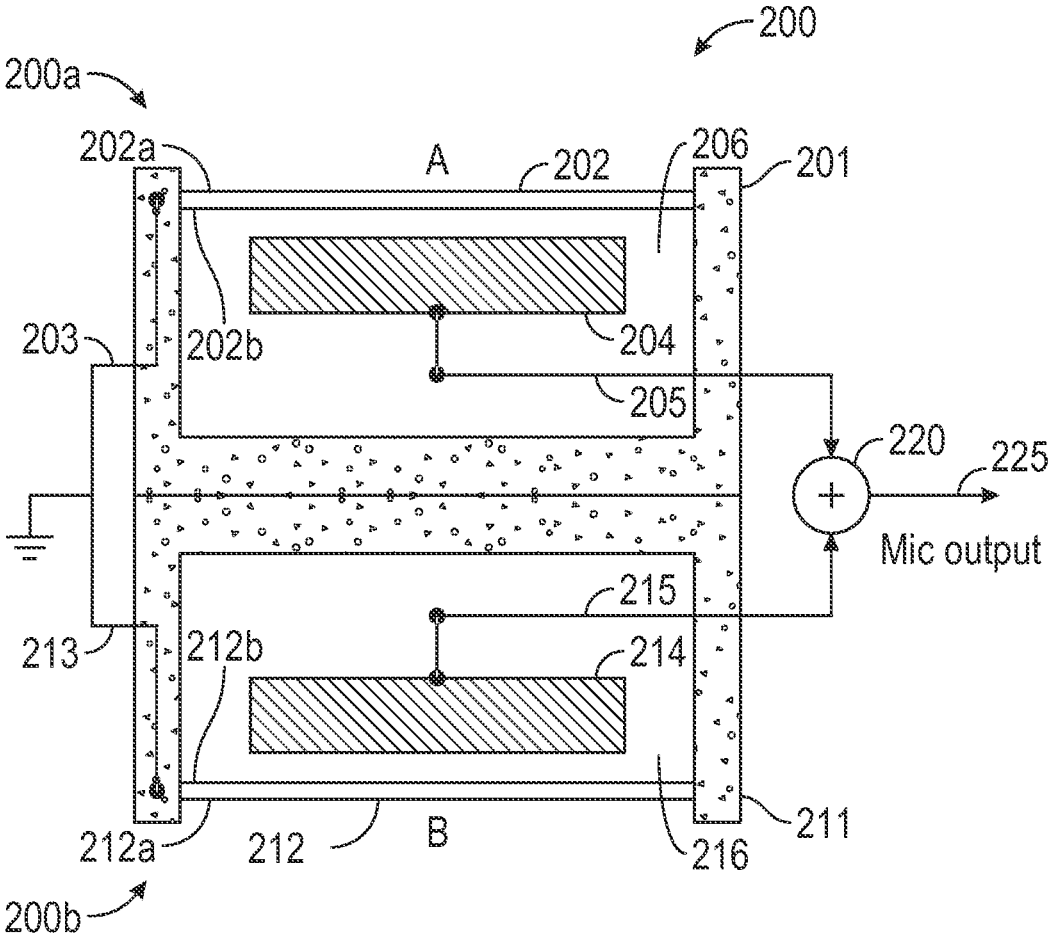
FIG. 4 illustrates an implementation of a dual diaphragm microphone configured to reduce the signal component caused by physical acceleration of the microphone.

FIG. 4 illustrates an implementation of a dual diaphragm microphone 200 configured to reduce the output signal component caused by physical acceleration of the microphone 200. Microphone 200 includes two sound-detecting components 200*a*, 200*b* oriented in opposite directions. In some implementations, each sound-detecting component 200*a*, 200*b* may include the components of the microphone 100 described above in reference to FIGS. 1-3B. In some implementations, the sound-detecting components 200*a*, 200*b* can be any acoustic-to-electric transducer or sensor that converts sound into an electrical signal based on movement of a subcomponent such as a deformable membrane. For example, in some implementations, each sound-detecting component may be a dynamic microphone, condenser microphone, electric condenser microphone, analog/digital MEMS microphone, or other suitable sound-detecting device.

In general, implementations of microphone 200 include a first sound-detecting component 200*a* oriented in a first direction. In some implementations, the first sound-detecting component 200*a* includes a first body 201, first diaphragm 202, and first sensing electrode 204. First diaphragm 202 is supported by first body 201 to define a first volume 206 which is at least partially enclosed. In some implementations, first volume 206 is filled with a volume of compressible air. First sensing electrode 204 is mounted within first volume 206 and spaced apart from first diaphragm 202. In some implementations, first sensing electrode 204 is rigidly mounted within first volume 206 to create a fixed spatial relationship between first body 201 and first sensing electrode 204.

First diaphragm 202 may be a pressure deformable membrane. In some implementations, an external side 202*a* of first diaphragm 202 is exposed to the ambient allowing sound waves to impact and deform the first diaphragm 202. Internal side 202*b* of first diaphragm 202 is oriented towards volume 206 and is spaced apart from the first sensing electrode 204. In some implementations, first diaphragm 202 is connected to a first ground terminal 203 for grounding the first diaphragm 202. The first sensing electrode 202 may be connected to a first output terminal 205, and an output signal of first sound-detecting component 200*a* can be measured at first output terminal 205. First output terminal 205 can be electrically connected to electronic circuitry 220 to form a combined output terminal 225.

Implementations of microphone 200 also include a second sound-detecting component 200*b* oriented in a second direction substantially opposite the first direction. The second sound-detecting component 200*b* may be rigidly attached to the first sound-detecting component 200*a*. In some implementations, the second sound-detecting component 200*b* includes a second body 211, second diaphragm 212, and second sensing electrode 214. In some implementations, second body 211 is integral with first body 201. For example, in some implementations, first and second bodies 201, 211 are formed as a single structure or assembly. In some implementations, first and second bodies 201, 211 may be separate pieces which are attached or secured to one another, either directly or indirectly. Second diaphragm 212 is connected to second body 211 to define a second volume 216 which is at least partially enclosed. In some implementations, second volume 216 is filled with a volume of compressible air. Second sensing electrode 214 is mounted within second volume 216 and spaced apart from second diaphragm 212. In some implementations, second sensing electrode 214 is rigidly mounted within second volume 216 to create a fixed spatial relationship between second body 211 and second sensing electrode 214.

Second diaphragm 212 may be a pressure deformable membrane. In some implementations, an external side 212*a* of second diaphragm 212 is exposed to the ambient, allowing sound waves to impact and deform the second diaphragm 212. Internal side 212*b* of second diaphragm 212 is oriented towards second volume 216 and spaced apart from the second sensing electrode 214. In some implementations, second diaphragm 212 is connected to a second ground terminal 213 for grounding the second diaphragm 212. In some implementations, the second sensing electrode 212 is connected to a second output terminal 215 and an output signal of the second sound-detecting device 200*b* can be measured at second output terminal 215. Second output terminal 215 can also be electrically connected to electronic circuitry 220 to form a combined output terminal 225. Accordingly, combined output terminal 225 can be used to measure the combined output signal of microphone 200, that is, the added output signals of the first and second sound-detecting components 200*a*, 200*b*.

As mentioned above, first and second sound-detecting components 200*a*, 200*b* can be rigidly attached or secured relative to each other to maintain their respective orientations relative to one another. In some implementations, first and second sound-detecting components 200*a*, 200*b* are formed in a single unitary housing which defines the first and second volumes 206, 216. In some implementations, first and second sound-detecting components 200*a*, 200*b* are formed as separate bodies (for example bodies 201, 211 described above) that are rigidly attached to each other. Accordingly, when microphone 200 undergoes acceleration, the first and second sound-detecting components 200*a*, 200*b* accelerate together.

Further, the first and second sound-detecting components 200*a*, 200*b* are oriented in opposite directions. Accordingly, in some implementations, interior surfaces 202*b*, 212*b* of first and second diaphragms 202, 212, respectively, may be disposed in an orientation so as to substantially face each other. In some implementations, the exterior surfaces 202*a*, 212*a* of first and second diaphragms 202, 212, respectively, may be disposed in an orientation so as to substantially face away from each other. In some implementations, first and second sensing electrodes 204, 214 are each contained within a space bounded on one side by a plane containing first diaphragm 202 and bounded on the other side by a plane containing the second diaphragm 212. In some implementations, the first sensing electrode 204 is disposed on a first side of the first diaphragm 202 along an axis normal to the first diaphragm 202 and the second sensing electrode 214 is disposed on a second side of the second diaphragm 212 along an axis normal to the second diaphragm, such that, for example, the first sensing electrode 204 is disposed below the first diaphragm 202 and the second sensing electrode 214 is disposed above the second diaphragm 212, or vice versa. In some implementations, first and second diaphragms 202, 212 are disposed in a parallel orientation.

As shown in FIG. 4, in some implementations of microphone 200, first diaphragm 202, first sensing electrode 204, first volume 206, second diaphragm 212, second diaphragm 212, second sensing electrode 214, and second volume 216 may be aligned along a single axis, the axis substantially orthogonal to the resting positions of the first and second diaphragms 202, 212. In some implementations, first and second sound-detecting components 200*a*, 200*b* may be disposed in a mirrored arrangement reflected across an axis perpendicular to an axis extending normal to the either diaphragm 202, 212. In some implementations, the first and second sound-detecting components 200*a*, 200*b* are stacked on top of one another. In some implementations, however, only some of these elements are aligned, and, in some implementations, none of these elements need be aligned.

In general, the output signal of microphone 200 is the combined output signals of each of the first and second sound-detecting components 200*a*, 200*b*. In some implementations, the output signals of the first and second sound-detecting components 200*a*, 200*b* are combined using electronic circuitry 220. In some implementations, the electronic circuitry 220 is a passive summation circuit. For example, in some implementations, the first output terminal 205 of the first sound-detecting component 200*a* can be directly connected to the second output terminal 215 of the second sound-detecting component 200*b*. The combined first and second output terminals 205, 215 are thereby added together to form a combined output terminal 225 at which the combined output signal of microphone 200 can be measured or electrically connected to other devices or circuits for further processing. In some implementations, electronic circuitry 220 may include active components configured to sum the output signals of the first and second sound-detecting components 200*a*, 200*b*. For example, in some implementations, electronic circuitry 220 may include a summing amplifier circuit including an operational amplifier.

Figure 5A:
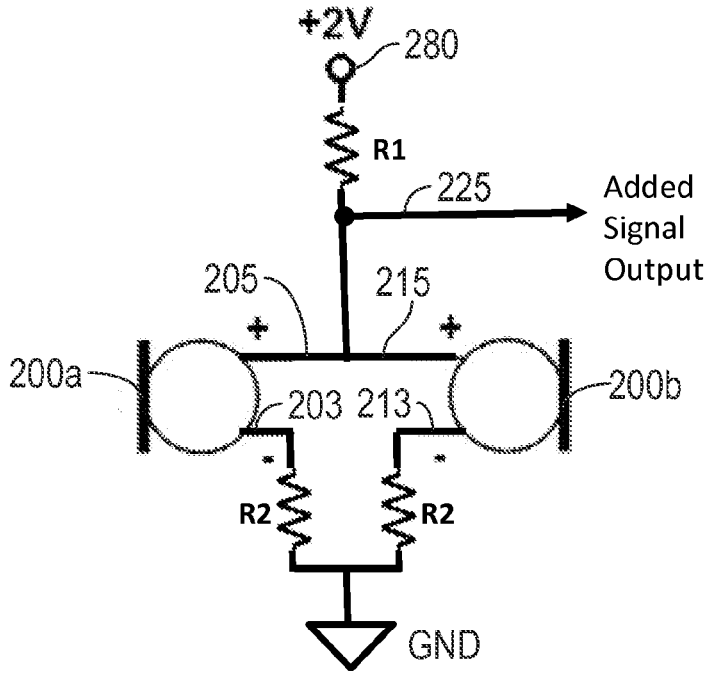
FIGS. 5A and 5B schematically illustrates exemplary circuit implementations configured to reduce the signal component caused by physical acceleration of the microphone shown in FIG. 4.
Figure 5B:
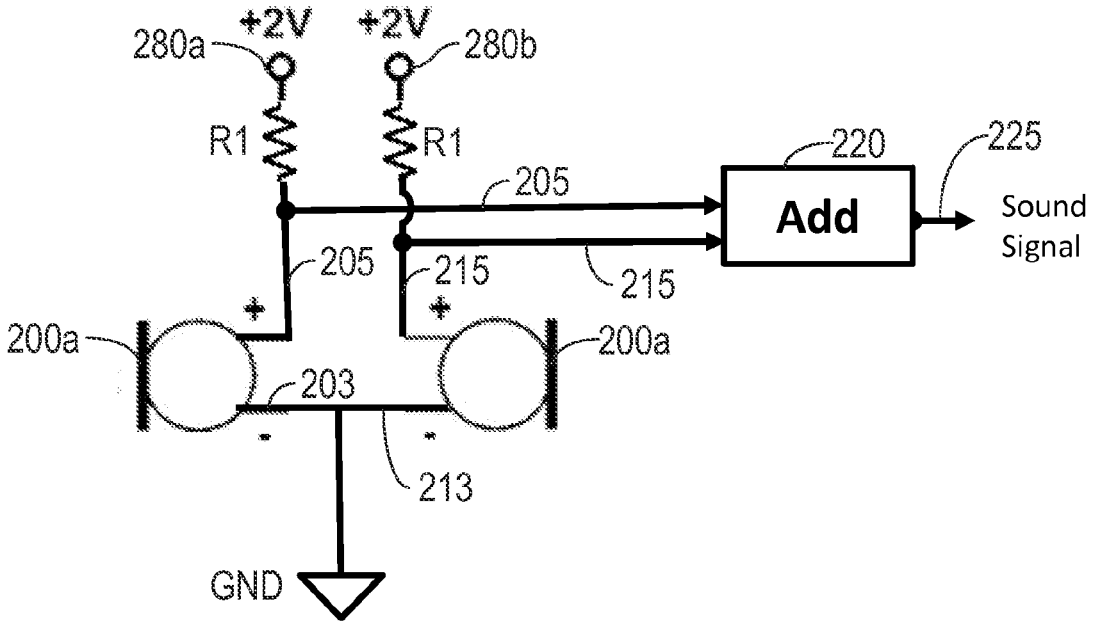

FIGS. 5A and 5B schematically illustrate example circuit implementations configured to reduce the signal component caused by physical acceleration of the microphone 200 shown in FIG. 4. The circuit implementation illustrated in FIG. 5A shows one example of a passive circuit that can be used with microphone 200. As shown, the circuit includes first and second sound-detecting components 200*a*, 200*b*, with diaphragms oriented in opposite directions, as shown in FIG. 4. As shown, the first and second output terminals 205, 215 of the first and second sound-detecting components 200*a*, 200*b*, respectively, are directly connected to each other to create the combined output terminal 205 of microphone 200. A voltage source 280 is also connected across a resistor R1 to the combined output terminal 225 and configured to provide a driving voltage for each of the first and second sound detecting components 200*a*, 200*b*.

The first and second sound-detecting components 200*a*, 200*b* also include first and second ground terminals 203, 213, respectively. As shown in the implementation of FIG. 5A, the first and second ground terminals 203, 213, are each connected to ground across resistors R2. In some implementations, the resistance of the resistors R1 and R2 may be adjusted, according to principles known in the art, to provide a clean output signal of microphone 200 at combined output terminal 205. In some implementations, the resistors R2 may each be selected to compensate for manufacturing variances between the first and second sound-detecting components 200*a*,200*b*. Accordingly, the resistance of each resistor R2 may be different. In some implementations, one or both of the resistors R1 and R2 may include a variable resistor. In some implementations, the resistors R1 and R2 may be omitted.

FIG. 5B illustrates one example of an active circuit that may be used with microphone 200. As shown, the first and second output terminals 205, 215 may each be independently connected to an active additive circuit 220, as known in the art, to create a combined output terminal 225 and a combined output signal. As shown, the first and second output terminals 205, 215 may also each be independently connected to voltage sources 280*a*, 280*b* across resistors R1. The first and second ground terminals 203, 213 may each be connected to ground. In some implementations, a resistor R2 (not shown in FIG. 5B) may be included between each sound-detecting component 200*a*, 200*b* and ground, as shown in FIG. 5A and described above. The principles presented in the schematic diagrams of FIGS. 5A and 5B may be varied according to principles known in the art. In some implementations, the difference between the signals from output terminals 205 and 215 may be obtained by subtracting one of the signals from output terminals 205 and 215 from the other, to obtain a signal indicative of the acceleration-induced component of these signals while reducing or eliminating the sound-induced component of these signals.

Figure 6A:
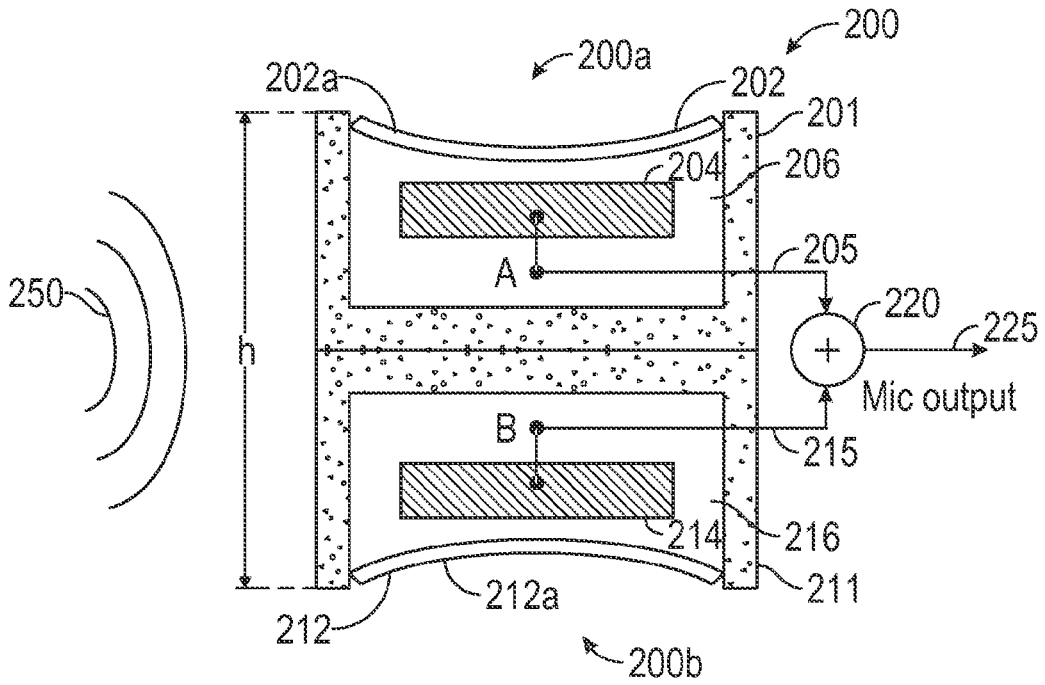
FIGS. 6A and 6B illustrate output signal generation in the dual diaphragm microphone shown in FIGS. 4 and 5 due to deformation of the diaphragm caused by sound and physical acceleration, respectively.
Figure 6B:
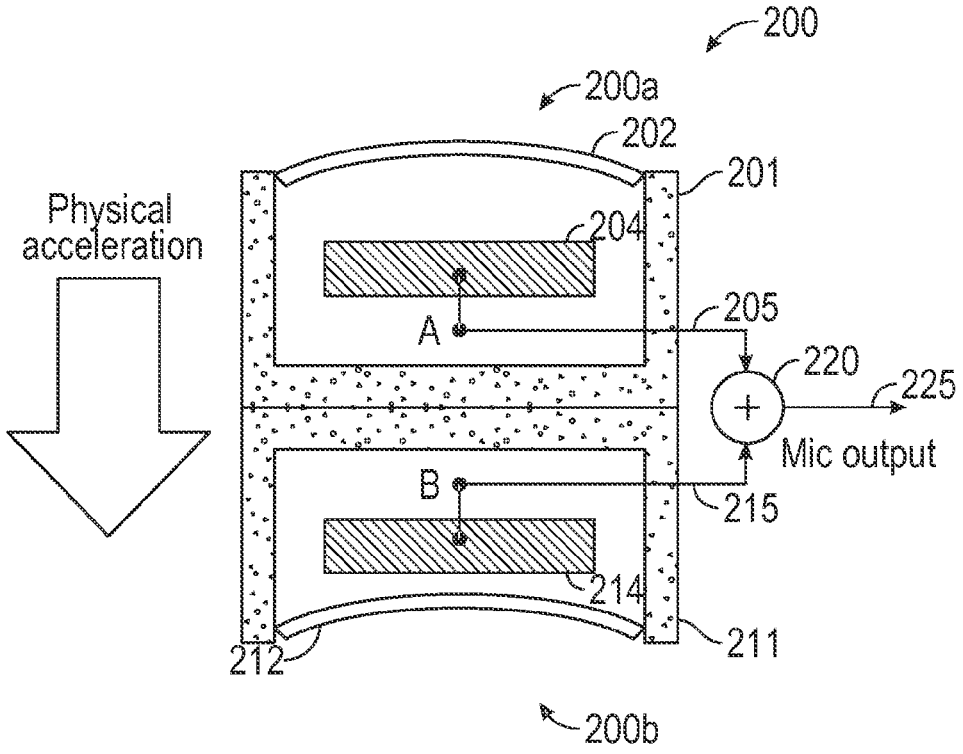

FIGS. 6A and 6B illustrate output signal generation in the implementation of the dual diaphragm microphone 200 shown in FIGS. 4 and 5 due to deformation of the diaphragms 202, 212 caused by sound waves 250 and physical acceleration, respectively. As shown and described below, microphone 200 is configured to generate a combined output signal indicative of the measured sound waves while eliminating or reducing any component of the output signal caused by acceleration of the microphone 200.

FIG. 6A illustrates output signal generation in a dual membrane microphone 200 due to deformation of the first and second diaphragms 202, 212 caused by sound waves 250. In some implementations, first and second sound-detecting components 200*a*, 200*b* need not be directional. That is, in some implementations, first and second sound-detecting components 200*a*, 200*b* are configured to measure sound waves 250 coming from any direction. Accordingly, any directionality of sound waves 250 indicated in FIG. 6A is provided for purposes of example only and is not intended to be limiting.

In some implementations, dual diaphragm microphone 200 has a total height h, as measured between the first and second diaphragms 202, 212, that is sufficiently small so that the effect of sound waves acting on each diaphragm 202, 212 is approximately the same. That is, in some implementations, microphone 200 is configured with a total height h such that changes in pressure act substantially equally, in time and magnitude, on the first and second diaphragms 202, 212. For example, in some implementations, microphone 200 has a total height h that is less than 5 mm, less than 4 mm, less than 3 mm, less than 2 mm, or less than 1 mm. A person of skill in the art will appreciate that for small heights h, sound waves 250 will cause substantially equal deformation of first and second diaphragms 202, 212. This is especially true for low frequency sounds, for example, sounds with a wave length that is much less than 2 mm. It is noted that, in some implementations, microphone 200 may exhibit a small directional gain difference due to the beam forming effect for high frequency sounds, but the pattern is substantially uni-directional for sounds with frequencies below 20 kHz. For example, for a microphone 200 with a height h that is approximately 2 mm, the phase difference between the two sound-detecting components 200*a*, 200*b* can be as large as 8.5 degrees for a 4 kHz sound wave. The gain drop of microphone 200 with an 8.5 degree phase difference is calculated to be about 0.024 dB, which is very minor. For a 20 kHz sound, the phase difference can be as large as 42.4 degrees causing a gain drop of about 0.61 dB, which again, is very minor.

As shown in FIG. 6A, sound waves 250 may cause each of diaphragms 202, 212 to inwardly deform toward their respective sensing electrodes 204, 214, due to a pressure differential between the sound waves 250 acting on the exterior surface 202*a*, 212*a* of each diaphragm 202, 212 and the interior pressure of volumes 206, 216. The inward deformation reduces the distance between each diaphragm 202, 212 and its respective sensing electrode 204, 214, causing each sound-detecting component 200*a*, 200*b* to produce a negative output signal. The output signal of the first sound-detecting component 200*a* is transmitted via first output terminal 205 to electronic circuitry 220 to be added to the output signal of the second sound-detecting component 200*b*. Accordingly, the combined output signal of microphone 200 caused by sound waves 250, is substantially equal to twice the output signal generated by either sound-detecting component (assuming that there is no acceleration-induced component). Although not specifically illustrated in FIG. 6A, synchronized outward deformation of each diaphragm 202, 212 will result in a similar combined output signal, although with an opposite polarity.

FIG. 6B depicts an implementation of the dual diaphragm microphone 200 shown in FIGS. 4-6A undergoing acceleration and illustrates how an implementation of the microphone 200 can be configured to reduce or eliminate the component of the output signal caused by the acceleration of the microphone 200. In FIG. 6B, microphone 200 is shown undergoing a downward acceleration. It will be appreciated, however, that the principles described here are applicable to any acceleration of microphone 200 that has any upward or downward component.

The body of microphone 200 includes a generally rigid material, such that it does not substantially deform when accelerated. As discussed above, the first and second sensing electrodes 204 and 214 are disposed within first and second volumes 206 and 216, respectively, and may be rigidly attached to the body of microphone 200. Sensing electrodes 204 and 214 are also generally sufficiently rigid so as to not deform when accelerated. Accordingly, as microphone 200 accelerates, the spatial relationship between the bodies 201 and 211 and the sensing electrodes 204 and 214 remains constant. First and second diaphragms 202, 212, however, are deformable membranes which may deform when accelerated.

For example, as shown in FIG. 6B, as first sound-detecting component 200*a* of microphone 200 accelerates in a downward direction, the first diaphragm 202 will not move downward at the same rate as the remainder of the microphone 200, resulting in an initial outward deformation of the diaphragm 202. The outward deformation increases the distance between first diaphragm 202 and first sensing electrode 204 producing a positive first output signal from the first sound detecting component 200*a*.

Second sound-detecting component 200*b* is rigidly attached to first sound-detecting component 200*a* and accordingly undergoes an equal acceleration. However, because second sound-detecting component 200*b* is oriented in a direction opposite the first sound-detecting component 200*a*, the acceleration generates an opposite output signal. For example, as second sound-detecting component 200*b* of microphone 200 accelerates in a downward direction, the second diaphragm 212 will not move downward at the same rate as the remainder of the microphone 200, resulting in an initial inward deformation of the diaphragm 212. The inward deformation decreases the distance between second diaphragm 212 and second sensing electrode 214 producing a negative second output signal from the second sound detecting component 200*b*.

In some implementations, the first and second diaphragms 202, 212 can be formed from the same deformable material and can have substantially similar dimensions, such that they will experience substantially the same deformation when under the effects of acceleration, although in opposite directions relative to respective sensing electrodes 204, 214. Accordingly, in the absence of incident sound waves, the output signals resulting from acceleration of the first and second sound-detecting components 200*a*, 200*b* will be substantially equal in magnitude and opposite in polarity. Summing these signals with electronic circuitry 220 produces a combined output signal at combined output terminal 225 with substantially no component caused by acceleration, such that the combined signal may, in some implementations, be substantially equal to zero.

As before, implementations of microphone 200 may not be sensitive to purely lateral accelerations. Nevertheless, these principles are applicable to any acceleration that has a component in the upward or downward direction.

It will be understood that the principles discussed above in reference to FIGS. 6A and 6B can be applied simultaneously to implementations of microphone 200 that experience both physical acceleration and changes in pressure due to sound waves 250. As discussed in reference to FIG. 6A, sound waves cause each sound-detecting component 200*a*, 200*b* to produce an output signal that is substantially equal in magnitude and polarity. The component of an output signal caused by sound is denoted herein as S. As discussed in reference to FIG. 6B, acceleration of microphone 200 causes each sound-detecting component 200*a*, 200*b* to produce a signal that is substantially equal in magnitude but opposite in polarity. The acceleration-induced signal component generated by the first sound-detecting component 200*a* is denoted herein as A and the acceleration-induced signal generated by the first sound-detecting component 200*b* is denoted herein as B.

Accordingly, when microphone 200 is exposed to both sound waves 250 and acceleration, the output signal $\text{Output}_{200a}$ generated by the first sound-detecting component 200*a* is a combination of the sound-induced component S and the acceleration-induced component A, such that:

$$\text{Output}_{200a}=S+A. \quad (1)$$

Similarly, the output signal $\text{Output}_{200b}$ of the second sound-detecting component 200*b* is a combination of the sound-induced component S and the acceleration-induced component B, such that:

$$\text{Output}_{200b}=S+B. \quad (2)$$

As noted above, because the first and second sound-detecting components 200*a*, 200*b* are rigidly attached and oriented in opposite directions, the acceleration-induced output signals of each will be equal in magnitude and opposite in polarity, such that:

$$B=-A. \quad (3)$$

When the output signals of the first and second sound-detecting components 200*a*, 200*b* are summed by electronic circuitry 220, the combined output $\text{Output}_{200}$ of microphone 200 is given by:

$$\text{Output}_{200}=\text{Output}_{200a}+\text{Output}_{200b}=S+A+S+B=S+A+S+(-A)=2S. \quad (4)$$

Because of the opposite orientation of the two sound-detecting components 200*a*, 200*b*, the output signal $\text{Output}_{200}$ of the microphone 200 includes only the sound-induced component S of the output signals $\text{Output}_{200a}$ and $\text{Output}_{200b}$, and is substantially free from either acceleration-induced component A or B, and is instead equal to double the component due to sound.

Figure 7:
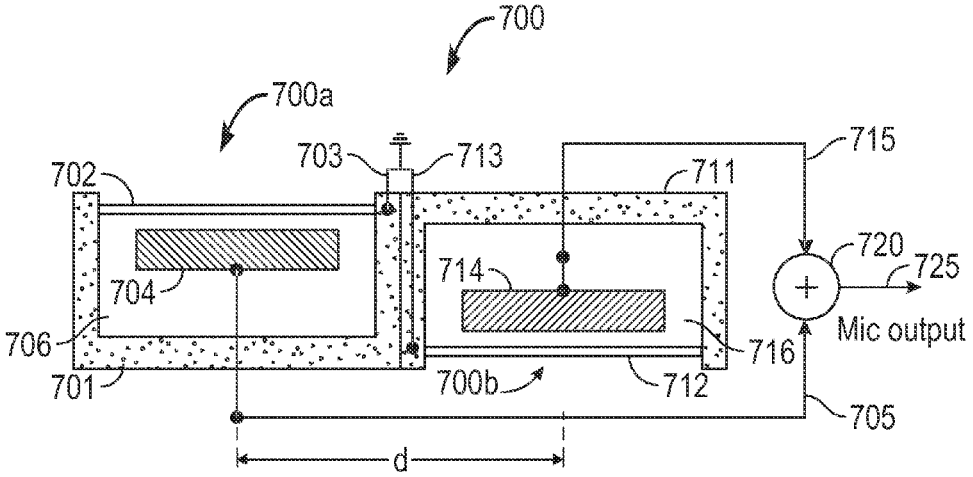
FIG. 7 illustrates an alternative implementation of a dual diaphragm microphone configured to produce an output signal substantially unaffected by physical acceleration of the microphone.

FIG. 7 illustrates an implementation of a dual diaphragm microphone 700 configured to produce an output signal substantially free from any component caused by physical acceleration of the microphone 700. The microphone 700 shown in FIG. 7 is similar to the microphone 200 described in reference to FIGS. 4-6B. For example, microphone 700 includes two sound-detecting components 700*a*, 700*b* oriented in opposite directions. In general, implementations of first sound-detecting component 700*a* includes a first diaphragm 702 attached to a first body 701, the first diaphragm 702 and the first body 701 defining an at least partially enclosed first volume 706, and a first sensing electrode 704 disposed within the first volume 706 and spaced apart from the first diaphragm 702. Similarly, implementations of second sound-detecting component 700*b* include a second diaphragm 712 attached to a second body 711, the second diaphragm 712 and the second body 711 defining an at least partially enclosed second volume 716, and a second sensing electrode 714 disposed within the second volume 716 and spaced apart from the second diaphragm 712. Each of these individual components may be substantially similar to corresponding components described above.

In the implementation shown in FIG. 7, the oppositely oriented first and second sound-detecting components 700*a*, 700*b* are laterally aligned. That is, the first and second volumes 706, 716 may be substantially aligned along an axis perpendicular to an axis extending orthogonally to either diaphragm 702, 712. In some implementations, the first sound-detecting component 700*a* is laterally offset from the second sound detecting component 700*b* by a lateral distance d, measured between axes extending normal to the center of each diaphragm 702, 712. In some implementations, the lateral distance d is sufficiently small so that the changes in air pressure and housing induced vibrations or accelerations acting on each diaphragm 702, 712 are approximately the same. That is, in some implementations, microphone 700 is configured with an offset lateral distance d between the first and second sound-detecting components 700*a*, 700*b* such that changes in pressure act substantially equally, in time and magnitude, on the first and second diaphragms 702, 712. For example, in some implementations, microphone 700 has a lateral offset distance d that is less than 5 mm, less than 4 mm, less than 3 mm, less than 2 mm, or less than 1 mm. In some implementations, the distance d is approximately equal to the diameter of the diaphragm 702, 712 of a sound-detecting component 700*a*, 700*b*. Many analog or digital sound-detecting components used in electronic devices have a diameter ranging between about 3 mm and 10 mm, with a 4 mm diameter being particularly common. A person of skill in the art will appreciate that for small distances d, sound waves will cause substantially equal deformation of first and second diaphragms 702, 712. This is especially true for low frequency sounds, for example, sounds with a wavelength less than 2 mm. In some implementations, microphone 700 may exhibit a small directional gain difference due to the beam forming effect for high frequency sounds, but the pattern is substantially uni-directional for sounds with frequencies below 20 kHz, as described above.

In some implementations of microphone 700 that include a lateral offset distance d, first and second diaphragms 702, 712 may be substantially aligned along an axis perpendicular to an axis extending normal to either diaphragm 702, 712. In some implementations, first and second sensing electrodes 704, 714 may be substantially aligned along an axis perpendicular to an axis extending normal to either diaphragm 702, 712.

As above, first and second output terminals 705, 715 of first and second sound-detecting components 700*a*, 700*b* are electrically connected to and summed with electronic circuitry 720. Accordingly, the implementation of microphone 700 shown in FIG. 7 is configured to produce a combined output signal at output terminal 705 that is substantially free from any component due to acceleration according to the principles discussed above in reference to FIGS. 6A and 6B.

Figure 8:
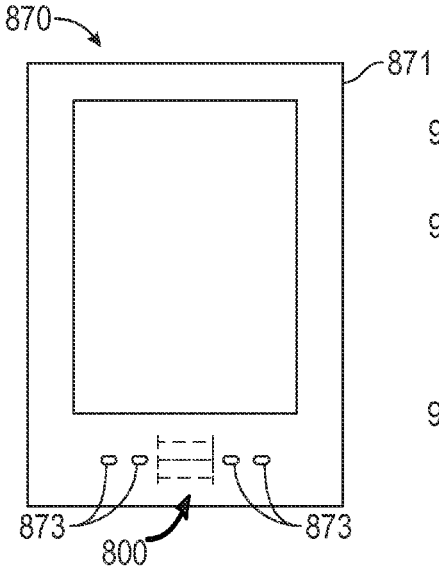
FIG. 8 illustrates an implementation of a dual diaphragm microphone integrated into a handheld device.

FIG. 8 illustrates an implementation of a dual diaphragm microphone 800 integrated into a handheld device 870. The dual diaphragm microphone 800 may be similarly configured to microphone 200 or microphone 700 described above. Implementations of the dual diaphragm microphone 800 configured according to the principles disclosed herein may advantageously be incorporated into any device that both measures sound and is likely to be moved during use. In some implementations, microphone 800 can be integrated into a handheld device 870 as shown. In some implementations, hand held device 870 can be a wireless communication device, for example, a laptop computer, a cellular phone, a smart phone, an e-reader, a tablet device, a gaming system, etc. Such devices are commonly hand held during use and accordingly may experience acceleration.

Figure 9:
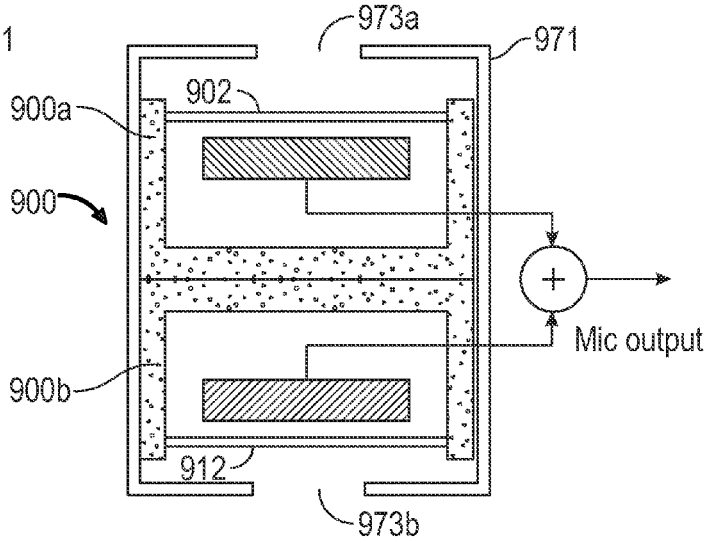
FIG. 9 illustrates an implementation of dual diaphragm microphone disposed within a housing including two apertures.
Figure 10:
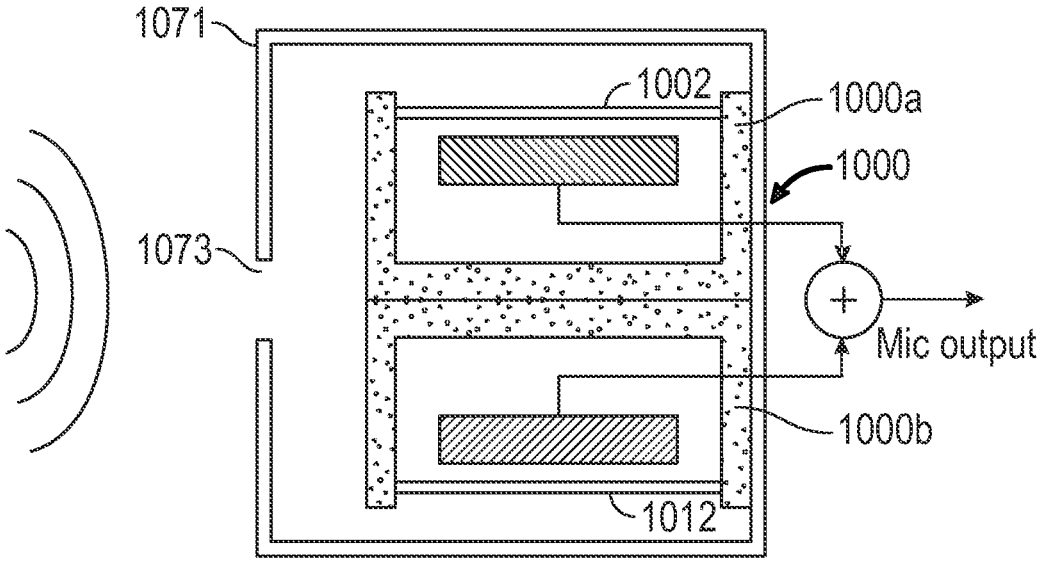
FIG. 10 illustrates an implementation of a dual diaphragm microphone disposed within a housing including a single aperture.
Figure 11:
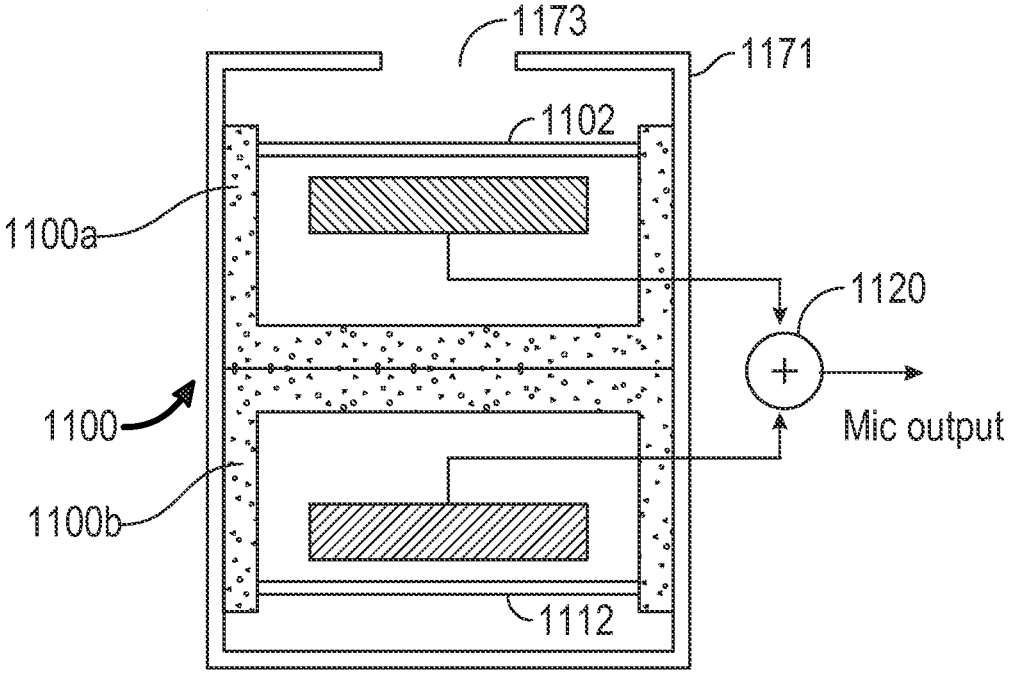
FIG. 11 illustrates an additional implementation of a dual diaphragm microphone disposed within a housing including a single aperture.

In some implementations, microphone 800 is disposed within a housing 871 of handheld device 870. Because the housing 871 may limit the ability of sound waves to reach the diaphragms and of microphone 800, the housing 871 may include one or more apertures 873, formed as holes extending through the housing 871, configured to allow sound waves to reach and deform the diaphragms of microphone 800. The location, number, and sizing of apertures 873 may vary according to the specific application. In some embodiments, each aperture 873 described in this application is a single hole, a plurality of holes, or an acoustic mesh. FIGS. 9-11 illustrate various arrangements of dual diaphragm microphones within housings configured with apertures.

FIG. 9 illustrates an implementation of a dual diaphragm microphone 900 disposed within a housing 971 with two apertures 973*a* and 973*b*. As shown, microphone 900 includes a first sound-detecting component 900*a* and a second sound detecting component 900*b* oriented in opposite directions. The microphone 900 is disposed within a housing 971 with two apertures 973*a* and 973*b*. Each of apertures 973*a* and 973*b* may include a hole, a plurality of holes, or an acoustic mesh extending through the housing 971 and configured to allow sound waves to enter the housing 971. In the implementation of FIG. 9, a first aperture 973*a* is disposed on a first side of housing 971 and is configured to allow sound waves to reach first diaphragm 902 of microphone 900. A second aperture 973*b* is disposed on a second side of housing 971 substantially opposite the first aperture 973*a*. Second aperture 973*b* is configured to allow sound waves to reach second diaphragm 912 of microphone 900.

FIG. 10 illustrates an implementation of a dual membrane microphone 1000 disposed within a single-aperture housing 1071. The aperture 1073 may be configured as a hole, plurality of holes, or acoustic mesh extending through a side surface of housing 1071. In some implementations, the aperture 1073 lies within a plane that is perpendicular to the planes of each of the first and second membranes 1002, 1012 of microphone 1000. In some implementations, the aperture 1073 is positioned on the housing 1071 such that the distance between the aperture 1073 and each of the first and second membranes 1002, 1012 is substantially equal. In some implementations, a single-aperture housing 1071, such as the implementation shown in FIG. 10, may be used where space requirements or other internal components of the device prevent the use of a multi-aperture housing or housing with apertures on more than a single side. In other implementations, a single-aperture housing 1071, may be used where directionality of the incoming sound is important. For example, in implementations where microphone 1000 is integrated into a handheld device such as a cellphone, a single aperture 1073 positioned towards the user's mouth may be desirable.

FIG. 11 illustrates another implementation of a dual membrane microphone 1100 disposed within a single-aperture housing 1171. In some implementations, microphone 1100 may be disposed within a housing 1171 containing a single aperture 1173. The single aperture 1173 may be configured as a hole, multiples holes, or an acoustic mesh extending through the housing 1171 and disposed so as to allow sound waves to reach one diaphragm, for example first diaphragm 1102, of microphone 1100. Housing 1171 may substantially sonically isolate the opposing diaphragm, for example second diaphragm 1112. In this implementation, first sound-detecting component 1100*a* is configured to generate signals due to sound and acceleration, and second sound-detecting device 1100*b* will generate signals substantially due only to acceleration. When the signals for the first and second sound-detecting devices 1100*a*, 1100*b* are added, the combined output of microphone 1100 will be substantially free from any component due to acceleration as follows.

As above, the component of an output signal caused by sound is denoted herein as S. The acceleration-induced signal component generated by the first sound-detecting component 1100*a* can be denoted is denoted herein as A, and the acceleration-induced signal component generated by the first sound-detecting component 1100*b* is denoted herein as B.

Accordingly, when microphone 1100 is disposed within an implementation of a housing 1171 as shown in FIG. 11 is exposed to both sound waves and acceleration, the output signal $\text{Output}_{200a}$ generated by the first sound-detecting component 1100*a* is a combination of the sound-induced component S and the acceleration-induced component A, such that:

$$\text{Output}_{200a}=S+A. \tag{5}$$

The output signal $\text{Output}_{200b}$ of the second sound-detecting component 1100*b* only includes the acceleration-induced component B because the housing 1171 sonically isolates the diaphragm 1112, such that:

$$\text{Output}_{200b}=\text{B}. \tag{6}$$

As noted above, because the first and second sound-detecting components 1100*a*, 1100*b* are rigidly attached and oriented in opposite directions, the acceleration-induced output signals of each will be equal in magnitude and opposite in polarity, such that:

$$B=-A. \tag{7}$$

When the output signals of the first and second sound-detecting components 1100*a*, 1100*b* are summed by electronic circuitry 1120, the combined output $\text{Output}_{200}$ of microphone 1100 is given by:

$$\text{Output}_{200}=\text{Output}_{200a}+\text{Output}_{200b}=S+A+B=S+A+(-A)=S. \tag{8}$$

Because of the opposite orientation of the two sound-detecting components 1100*a*, 1100*b*, the output signal $\text{Output}_{200}$ of the microphone 1100 includes only the sound-induced component S, and is substantially free from either acceleration-induced component A or B, and is instead equal to component due to sound measured by the first sound-detecting component 1100*a*.

One of skill in the art will appreciate that other arrangements of apertures are possible and within the scope of the present disclosure.

Figure 12:
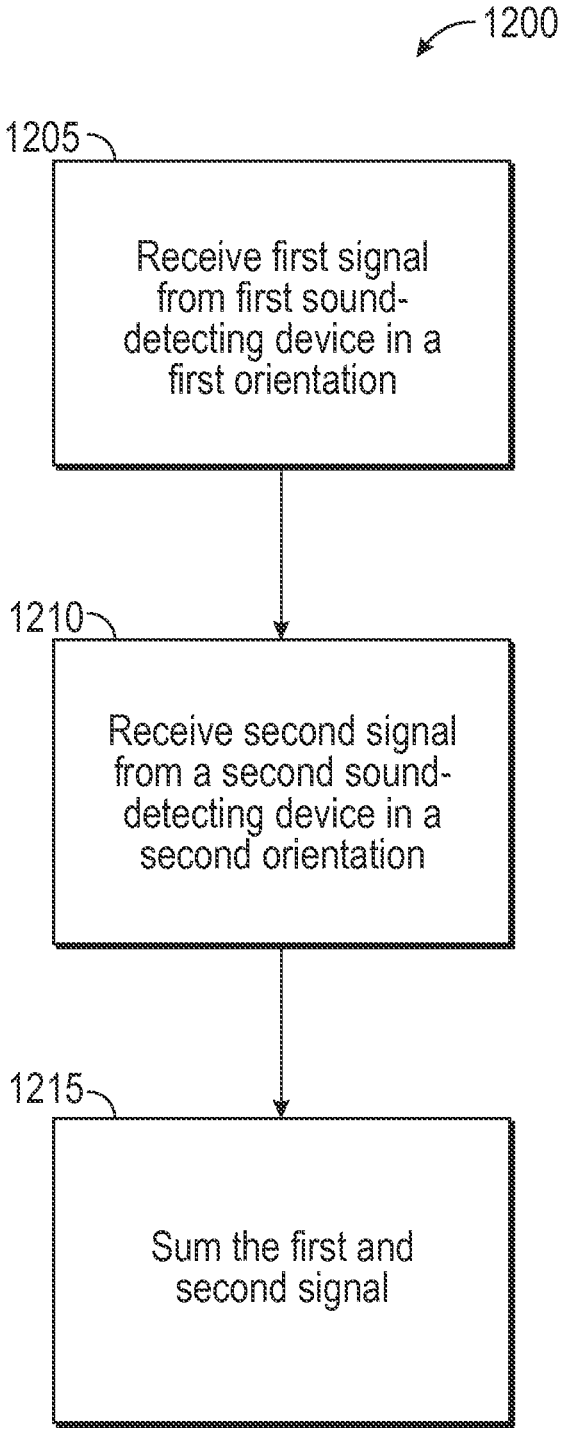
FIG. 12 is a flowchart illustrating a method for producing an output signal substantially free from any component due to physical acceleration.

FIG. 12 is a flowchart illustrating a method 1200 for producing an output signal which is substantially unaffected by physical acceleration or other movement of the recording device. Method 1200 begins at block 1205, where a first signal is received from a first sound-detecting device oriented in a first direction. The first signal may include components caused by both measured sound and physical acceleration of the first sound-detecting device.

At block 1205, a second signal is received from a second sound-detecting device oriented in a second direction substantially opposite the first direction. The second signal may include components caused by both measured sound and physical acceleration of the first sound-detecting device. The second received signal is generally caused by the same measured sound and the same physical acceleration.

At block 1215, the first and second signals are summed. In some implementations, the summing is accomplished by simply joining the signal lines from which the first and second signals are received. In some implementations, summing is accomplished using an active summation circuit. In some implementations, the summing the first and second signals results in a combined signal that is substantially unaffected by acceleration or other movement of the recording device, because the opposite orientation of the first and second sound-detecting devices results in generation of substantially equal and opposite signal components due to acceleration. When the first and second signals are added together, the components due to acceleration cancel each other out.

Figure 13:
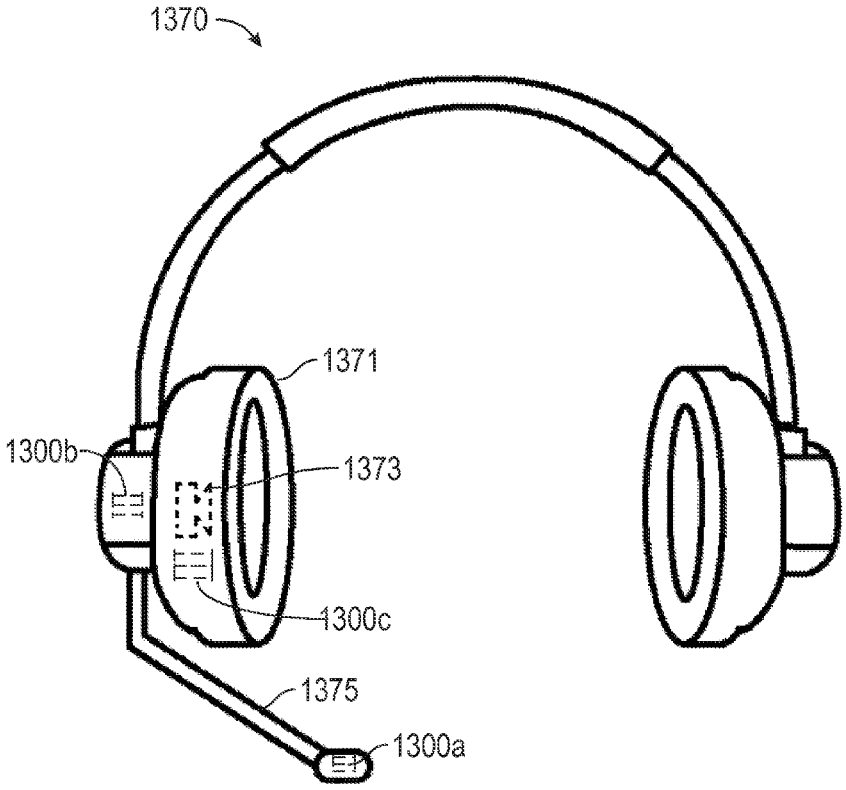
FIG. 13 illustrates an implementation of a headset including a dual diaphragm microphone.

FIG. 13 illustrates an implementation of a headset including a dual diaphragm microphone. The headset 1370 may include one or more acoustic enclosures 1371 configured to surround an ear of a user. One or more speakers 1373 may be included within each acoustic enclosure 1371 and configured to deliver sound to the user's ear. FIG. 13 illustrates three possible positions of microphones within the headset 1370 at locations 1300*a*, 1300*b*, and 1300*c*. A microphone positioned at any of possible microphone locations 1300*a*, 1300*b*, or 1300*c* may be configured as described above to reduce or eliminate any acceleration induced output signal components. Although, three possible microphone locations 1300*a*, 1300*b*, 1300*c* are shown in FIG. 13, in some embodiments, the headset 1370 may not include a microphone at each of the three locations 1300*a*, 1300*b*, and 1300*c*. For example, the headset 1370 may include only a single microphone at location 1300*a*, or headset 1370 may include two microphones at location 1300*a* and location 1300*c*. In some embodiments, the headset 1370 may include three or more microphones, and may include microphones at any other location in or on headset 1370.

In some embodiments, the headset 1370 may include a boom or other structure 1375 that may extend from the acoustic enclosure 1371 or another component of the headset 1370, so that a microphone positioned at location 1300*a* may be positioned generally in front of a user's mouth when the head set is in use, or at another location along the side of a user's face. In some embodiments, the headset 1370 may include one or more microphones positioned at location 1300*b* outside of the acoustic enclosures 1371. In some embodiments, the headset 1370 may include one or more microphones positioned at location 1300*c* within the acoustic enclosures 1371.

A dual diaphragm microphone as described above may advantageously be incorporated into various wearable devices, for example, earphones, headsets, headphones, hearing aids, or other wearable devices, in order to reduce the effect of movement of the user on the audio signal captured or generated by the wearable device.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It should be noted that the terms "attach," "attached," or other variations of the word "attach," or similar words, as used herein may indicate either an indirect connection or a direct connection. For example, if a first component is attached or rigidly mounted to a second component, the first component may be either indirectly connected to the second component or directly connected to the second component. As used herein, the term "plurality" denotes two or more. For example, a plurality of components indicates two or more components.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, relative terms such as "upper" and "lower" are sometimes used for ease of describing the figures, and indicate relative positions corresponding to the orientation of the figure on a properly oriented page, and may not reflect the proper orientation of a particular component as implemented or during use.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some housings be excised from the combination, and the claimed combination may be directed to a subcombination or variation of a subcombination.

Similarly, while operations are depicted in the drawings in a particular order, a person having ordinary skill in the art will readily recognize that such operations need not be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some housings, the actions recited in the claims can be performed in a different order and still achieve desirable results.

What is claimed is:

1. A microphone comprising:

a first microphone component configured to generate a first signal, comprising a first pressure deformable diaphragm having an external side facing a first direction, the first signal varying with deformation of the first deformable diaphragm, and a first electrode spaced apart from an internal side of the first pressure deformable diaphragm and disposed within a first volume at least partially enclosed by the first pressure deformable diaphragm;

a second microphone component configured to generate a second signal, comprising a second pressure deformable diaphragm having an external side facing a second direction, the second signal varying with deformation of the second deformable diaphragm, and the second direction being substantially opposite the first direction, and a second electrode spaced apart from the second pressure deformable diaphragm and disposed within a second volume at least partially enclosed by the second pressure deformable diaphragm; and electronic circuitry configured to sum the first and second signals to generate an output signal.

2. The microphone of claim 1, wherein the first microphone component is rigidly attached to the second microphone component.

3. The microphone of claim 1, wherein the first pressure deformable diaphragm is oriented in a position parallel to the second pressure deformable diaphragm.

4. The microphone of claim 1, wherein the output signal is substantially unaffected by acceleration of the microphone.

5. The microphone of claim 1, wherein the electronic circuitry comprises a passive summation circuit.

6. The microphone of claim 1, wherein the electronic circuitry comprises an active summation circuit.

7. The microphone of claim 1, wherein the first microphone component and the second microphone component are aligned along an axis perpendicular to the first pressure deformable diaphragm.

8. The microphone of claim 1, wherein the first microphone component is laterally offset from the second microphone component.

9. The microphone of claim 1, wherein each of the first and second pressure deformable diaphragms is exposed to the ambient.

10. The microphone of claim 1, wherein the first pressure deformable diaphragm is oriented in a position parallel to the second pressure deformable diaphragm.

11. A dual-diaphragm microphone comprising:

a first pressure deformable diaphragm at least partially enclosing a first volume;

a first sensing electrode disposed within the first volume and spaced apart from the first pressure deformable diaphragm, the first sensing electrode configured to generate a first signal varying with deformation of the first pressure deformable diaphragm;

a second pressure deformable diaphragm at least partially enclosing a second volume, the second pressure deformable diaphragm oriented substantially parallel to the first pressure deformable diaphragm;

a second sensing electrode disposed within the second volume and spaced apart from the second pressure deformable diaphragm, the second sensing electrode configured to generate a second signal varying with deformation of the second pressure deformable diaphragm, the first and second sensing electrodes disposed respectively on opposite sides of the first and second pressure deformable diaphragms; and electronic circuitry configured to sum the first and second signals to generate an output signal.

12. The microphone of claim 11, further comprising a body, and wherein the first and second volumes are at least partially defined by the body.

13. The microphone of claim 11, wherein the first and second volumes are substantially aligned along an axis extending perpendicularly to the first pressure deformable diaphragm.

14. The microphone of claim 13, wherein the first and second pressure deformable diaphragms and the first and second sensing electrodes are also substantially aligned along the axis extending perpendicularly to the first pressure deformable diaphragm.

15. The microphone of claim 11, wherein the first and second volumes are substantially aligned along an axis perpendicular to an axis extending perpendicularly to the first pressure deformable diaphragm.

16. A method, comprising:

receiving a first signal from a first sound-detecting component oriented in a first direction, the first sound-detecting component comprising:

a first pressure deformable diaphragm having an external side facing the first direction, the first signal varying with deformation of the first deformable diaphragm, and a first electrode spaced apart from an internal side of the first pressure deformable diaphragm and disposed within a first volume at least partially enclosed by the first pressure deformable diaphragm;

receiving a second signal from a second sound-detecting component rigidly attached to the first sound-detecting component and oriented in a second direction substantially opposite the first direction, the second sound-detecting component comprising:

a second pressure deformable diaphragm having an external side facing the second direction, the second signal varying with deformation of the second deformable diaphragm, and a second electrode spaced apart from the second pressure deformable diaphragm and disposed within a second volume at least partially enclosed by the second pressure deformable diaphragm; and summing the first and second signals to produce a combined output that is substantially free from signal components generated by acceleration of the first and second sound-detecting components.

17. The method of claim 16, wherein the first and second pressure deformable diaphragms are configured such that a component of the first and second signals caused by changes in air pressure is substantially equal in magnitude and polarity.

18. The method of claim 16, wherein the first and second pressure deformable diaphragms are configured such that a component of the first and second signals caused by acceleration of the microphone is substantially equal in magnitude and opposite in polarity.

19. The method of claim 16, wherein summing the first and second signals comprises using a passive summation circuit to sum the first and second signals.

20. The method of claim 16, wherein summing the first and second signals comprises using an active summation circuit to sum the first and second signals.

21. A microphone comprising:

a first microphone component configured to generate a first signal, comprising a first pressure deformable diaphragm having an external side facing a first direction, the first signal varying with deformation of the first deformable diaphragm, and a first electrode spaced apart from an internal side of the first pressure deformable diaphragm and disposed within a first volume at least partially enclosed by the first pressure deformable diaphragm;

a second microphone component configured to generate a second signal, comprising a second pressure deformable diaphragm having an external side facing a second direction, the second signal varying with deformation of the second deformable diaphragm, and the second direction being substantially opposite the first direction, and a second electrode spaced apart from the second pressure deformable diaphragm and disposed within a second volume at least partially enclosed by the second pressure deformable diaphragm;

a housing configured to at least partially surround the first microphone component and the second microphone component, the housing including at least one aperture configured to expose the first pressure deformable diaphragm to the ambient, the housing sonically isolating the second pressure deformable diaphragm; and electronic circuitry configured to sum the first and second signals to generate an output signal.

22. The microphone of claim 21, wherein the first microphone component is rigidly attached to the second microphone component.

23. The microphone of claim 22, wherein the first pressure deformable diaphragm is oriented in a position parallel to the second pressure deformable diaphragm.

24. The microphone of claim 23, wherein the output signal is substantially unaffected by acceleration of the microphone.

25. The microphone of claim 21, wherein the first microphone component and the second microphone component are aligned along an axis perpendicular to the first pressure deformable diaphragm.

26. The microphone of claim 21, wherein the first microphone component is laterally offset from the second microphone component.

27. The microphone of claim 21, wherein the electronic circuitry comprises a passive summation circuit.

28. The microphone of claim 21, wherein the electronic circuitry comprises an active summation circuit.

29. The microphone of claim 21, wherein the at least one aperture comprises an acoustic mesh.

* * * * *